US012534890B1

(12) United States Patent
Yan

(10) Patent No.: US 12,534,890 B1
(45) Date of Patent: Jan. 27, 2026

(54) WATERWAY SWITCHING APPARATUS WITH MAGNETIC FUNCTION

(71) Applicant: XIAMEN GALENPOO KITCHEN&BATHROOM TECHNOLOGY CO., LTD, Xiamen (CN)

(72) Inventor: Xiaoling Yan, Xiamen (CN)

(73) Assignee: XIAMEN GALENPOO KITCHEN&BATHROOM TECHNOLOGY CO., LTD, Xiamen (CN)

( * ) Notice: Subject to any disclaimer, the term of this patent is extended or adjusted under 35 U.S.C. 154(b) by 0 days.

(21) Appl. No.: 19/015,547

(22) Filed: Jan. 9, 2025

(51) Int. Cl.
*E03C 1/04* (2006.01)
*E03C 1/02* (2006.01)

(52) U.S. Cl.
CPC ..... *E03C 1/0408* (2013.01); *E03C 2001/026* (2013.01)

(58) Field of Classification Search
CPC ..... E03C 1/023; E03C 1/0408; E03C 1/0409
See application file for complete search history.

(56) References Cited

U.S. PATENT DOCUMENTS 7,121,303 B1 * 10/2006 Hwang ..... E03C 1/042 4/615
11,525,249 B1 * 12/2022 Yan ..... B05B 1/1672
11,636,743 B1 * 4/2023 Brown ..... E03C 1/0408 340/539.18
12,139,896 B2 * 11/2024 Huang ..... E03C 1/0408
2013/0299608 A1 * 11/2013 Spangler ..... A47K 3/28 239/525
2013/0340854 A1 * 12/2013 Quinn ..... E03C 1/0409 137/343
2019/0022671 A1 * 1/2019 Jack ..... B05B 1/18
2021/0060598 A1 * 3/2021 Lee ..... B05B 15/62
2022/0126310 A1 * 4/2022 Dai ..... E03C 1/06
2022/0193700 A1 * 6/2022 Lev ..... B05B 1/1636
2023/0356239 A1 * 11/2023 Yan ..... B05B 15/62

FOREIGN PATENT DOCUMENTS

GB 2625672 A 6/2024

* cited by examiner

*Primary Examiner* — Reinaldo Sanchez-Medina
(74) *Attorney, Agent, or Firm* — FIDELI LAW PLLC; Qiang Li

(57) ABSTRACT

This patent discloses a waterway switching apparatus with a magnetic function, which can functionally replace a shower column, achieving mounting and fixation of an overhead shower and a handheld shower, with a simple structure and reduced costs. The waterway switching apparatus changes communication relationships of a first water inlet with a water flowing slot and a second water inlet as a waterway adjusting member rotates, achieving communication with a first connection port via the water flowing slot, or communication with a second connection port via the second water inlet. The shower fixing apparatus is mounted on an outer side of the housing and is configured to magnetically fix the handheld shower.

4 Claims, 3 Drawing Sheets

WATERWAY SWITCHING APPARATUS WITH MAGNETIC FUNCTION

BACKGROUND

1. Technical Field

This patent pertains to the technical field of bathroom equipment, specifically referring to a waterway switching apparatus with a magnetic function.

2. Background Information

In bathrooms, shower-type water-outputting apparatuses generally include overhead showers and handheld showers. In the prior art, both are usually mounted on a shower column, where the overhead shower is relatively fixed in position, while the handheld shower can be removed for flexible use.

Because the shower column is fixed vertically against a wall during mounting, occupying a certain height space, it is more suitable for the design of existing Chinese bathrooms where the water inlet pipe is lower and closer to the ground. However, for American bathrooms, due to the higher position of the water inlet pipe closer to the ceiling, the shower column is no longer suitable.

BRIEF SUMMARY

An objective of this patent is to provide a waterway switching apparatus with a magnetic function, which can address the issues in the prior art and functionally replace the shower column, achieving the mounting and fixation of both the overhead shower and the handheld shower, with a simple structure and rich functions.

To achieve the above objective, this patent provides the following solution:

A waterway switching apparatus with a magnetic function is provided, including a housing, a waterway adjusting member, and a shower fixing apparatus. The housing is provided with a water flowing chamber, and a first water inlet and a first connection port that communicate with the water flowing chamber; the waterway adjusting member rotatably fits in the water flowing chamber and movably seals an opening of the water flowing chamber, two sides of a peripheral surface of an inner-side end thereof are respectively provided with a water flowing slot and a second water inlet, and an outer-side end of the waterway adjusting member is provided with a second connection port; as the waterway adjusting member rotates, communication relationships of the first water inlet with the water flowing slot and the second water inlet are changed, to achieve communication with the first connection port via the water flowing slot or with the second connection port via the second water inlet; and the shower fixing apparatus is mounted on an outer side of the housing opposite the first water inlet and is configured to magnetically fix a handheld shower.

Peripheral surfaces of outer ends of the first connection port and the second connection port are each provided with an external thread.

A peripheral surface of the waterway adjusting member is provided with at least one mounting ring slot, a sealing ring is disposed in the mounting ring slot, and the sealing ring movably and sealingly fits between the peripheral surface of the waterway adjusting member and an inner wall of the opening of the water flowing chamber.

A first sealing gasket is embedded around the second water inlet, and the first sealing gasket movably and sealingly fits with an inner wall of the water flowing chamber as the waterway adjusting member rotates.

A peripheral surface of the outer-side end of the waterway adjusting member is provided with a toggle.

The peripheral surface of the inner-side end of the waterway adjusting member is provided with a movable slot, a limiting pin is mounted in the housing, and the limiting pin movably fits in the movable slot.

A peripheral surface of the housing is provided with a mounting slot, and the shower fixing apparatus includes a fixed seat fixed relatively in the mounting slot and a magnet embedded in the fixed seat.

Preferably, several fixed posts are disposed in the mounting slot, the fixed seat is fixed to the fixed posts by screws, a protective cover for covering the screws is mounted on a surface of the fixed seat through snap connection, and a limiting cover is disposed in the fixed seat and configured to relatively fix the magnet in the mounting slot.

A connection ball head is mounted in the first water inlet, and the connection ball head is connected to a water supply pipe.

Preferably, the waterway switching apparatus with a magnetic function further includes a limiting nut threadedly connected to the housing, a limiting ring disposed in the limiting nut and configured to prevent the connection ball head from loosening and shaking, and a second sealing gasket disposed between the connection ball head and the first water inlet.

After the use of the above technical solutions, this patent has the following technical effects:

(1) According to this patent, the shower column in the bathroom can be functionally replaced, and the overhead shower and the handheld shower can both be mounted on the housing. Specifically, the overhead shower is connected to the first connection port to achieve relative fixation with the housing and the water inlet function of the overhead shower; and the handheld shower is detachably mounted on the shower fixing apparatus by magnetic means, making the operation convenient and quick, and connected to the second connection port via a water pipe to achieve the water inlet function of the handheld shower.

(2) The waterway adjusting member can not only supply water to the handheld shower but also provide the waterway switching function. By rotating the waterway adjusting member, the user can change the relative angle between the water flowing slot, the second water inlet, and the first water inlet, thus determining which waterway the first water inlet communicates with, achieving the opening, closing, and switching functions of the waterway. This results in rich functions and simple operation; especially a corresponding waterway is opened for the handheld shower when the handheld shower is removed from the housing, making the operation handy and convenient, thus providing an excellent user experience.

Figure 1:
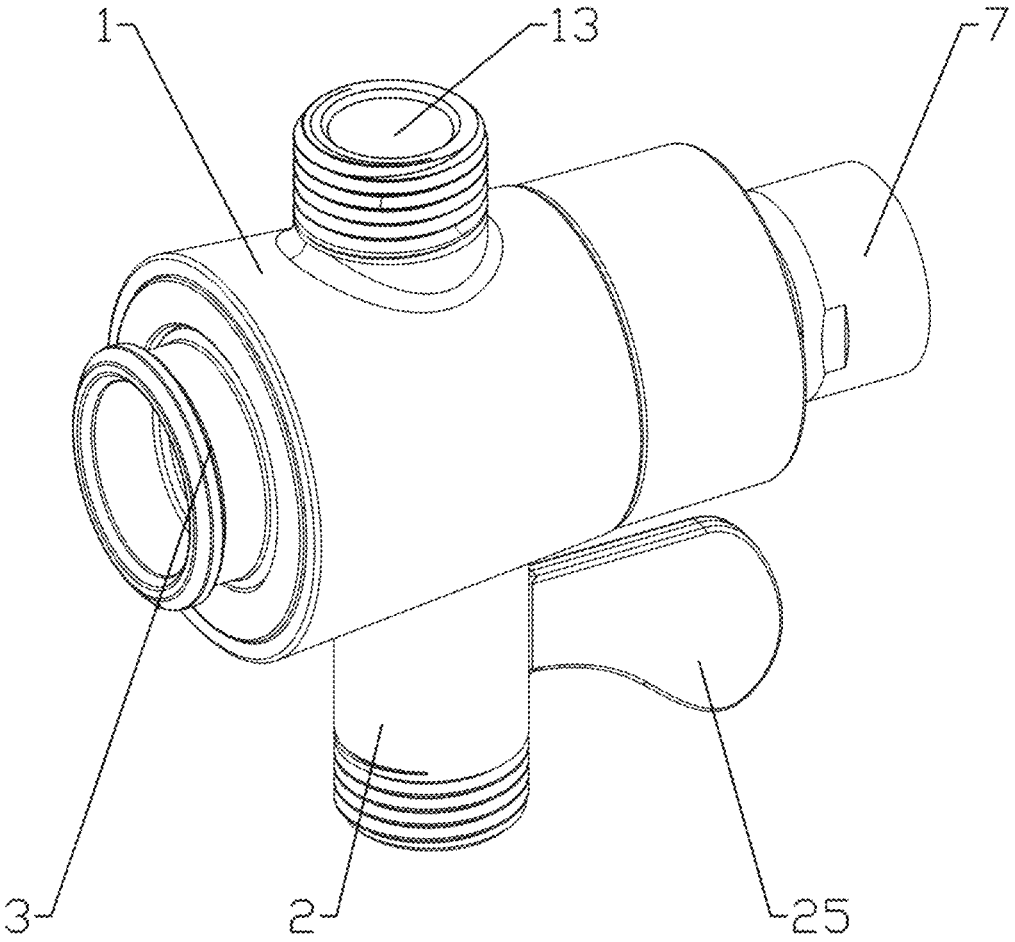
FIG. 1 is a perspective view of this patent.

Description of reference numerals in the drawings:

1. housing; 11. water flowing chamber; 12. first water inlet; 13. first connection port; 14. mounting slot; 15. fixed post; 2. waterway adjusting member; 21. water flowing slot; 22. second water inlet; 23. second connection port; 24.

mounting ring slot; 25. toggle; 26. movable slot; 3. shower fixing apparatus; 31. fixed seat; 32. magnet; 33. protective cover; 34. limiting cover; 4. sealing ring; 5. first sealing gasket; 6. limiting pin; 7. connection ball head; 8. limiting nut; 9. limiting ring; and 10. second sealing gasket.

DETAILED DESCRIPTION OF THE DRAWINGS AND THE PRESENTLY PREFERRED EMBODIMENTS

To further explain the technical solutions of this patent, this patent is described in detail with reference to specific embodiments.

Figure 2:
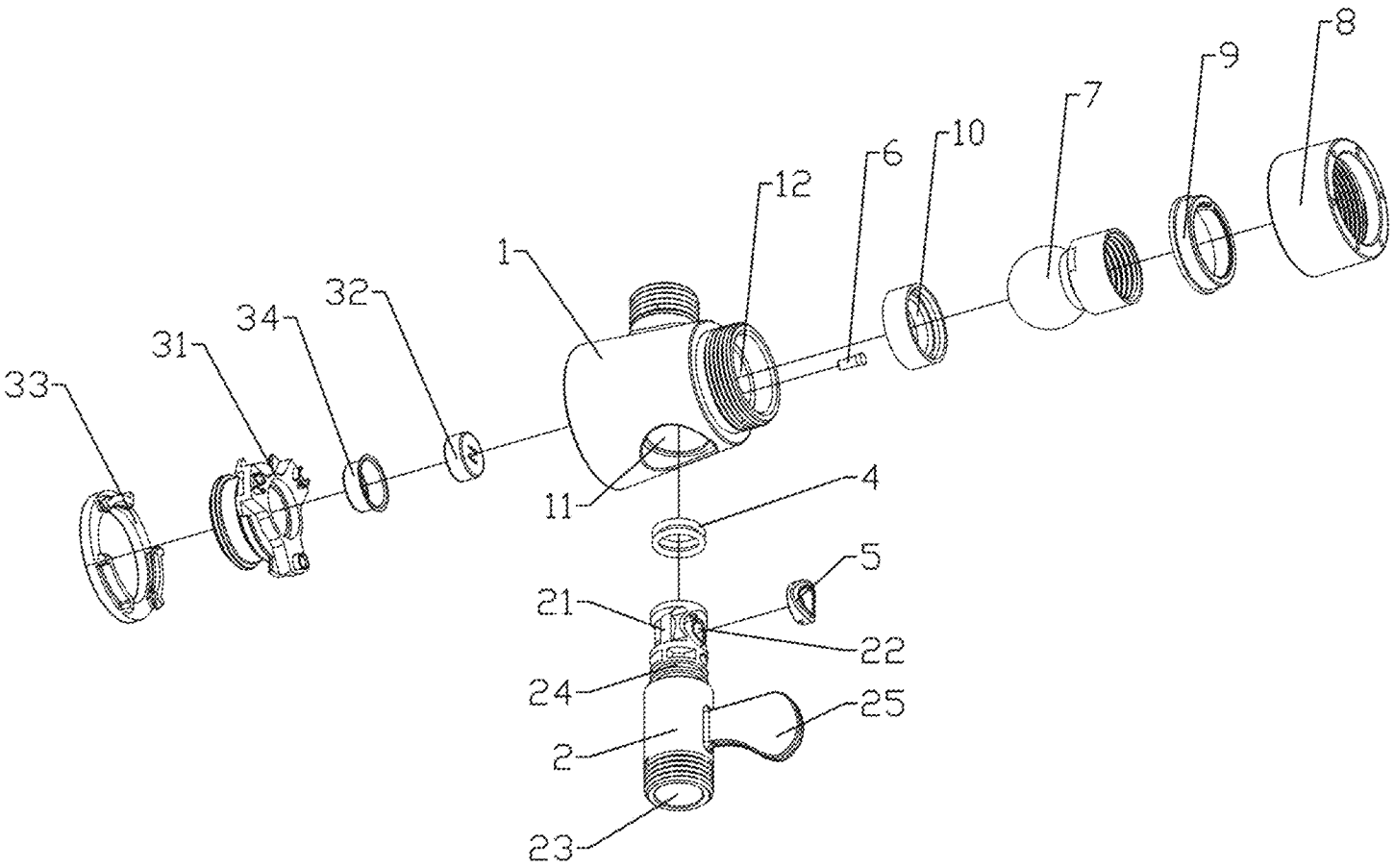
FIG. 2 is an exploded view of this patent.
Figure 3:
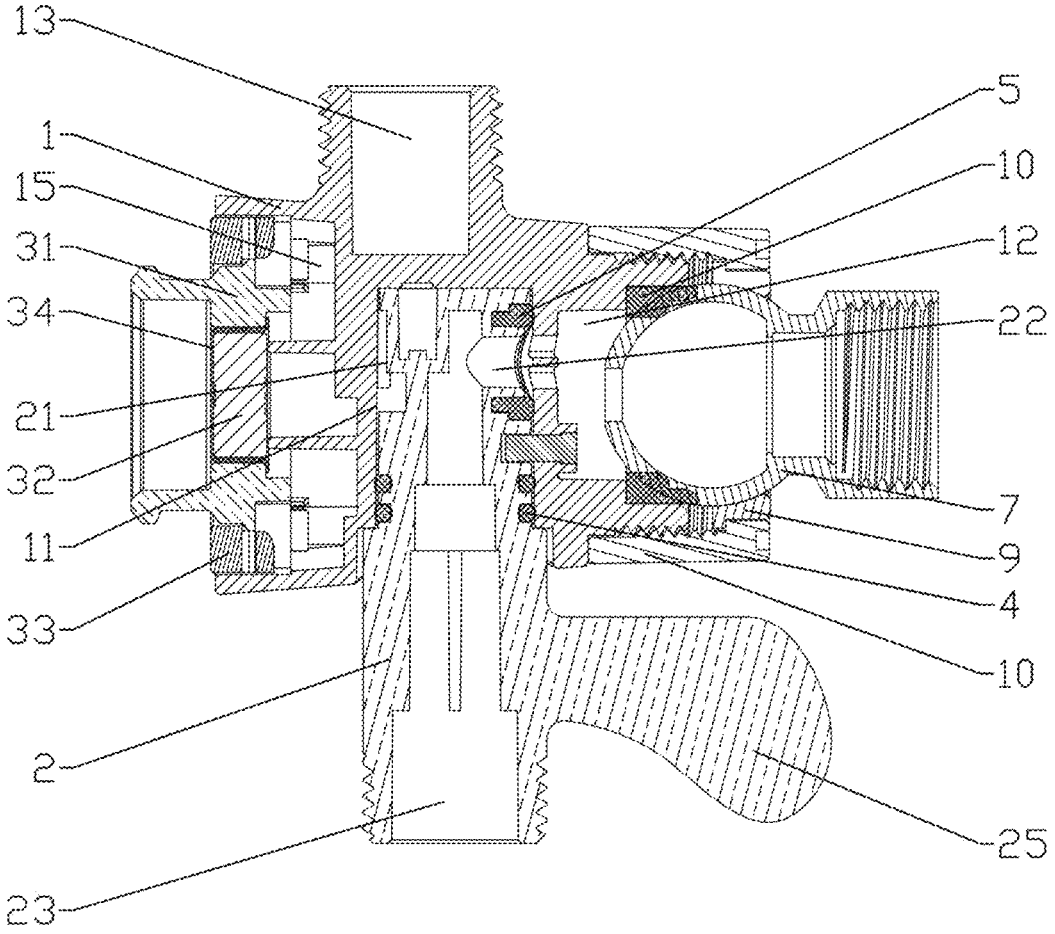
FIG. 3 is a cross-sectional view of this patent.

Referring to FIGS. 1 to 3, this patent discloses a waterway switching apparatus with a magnetic function, including a housing 1, a waterway adjusting member 2, and a shower fixing apparatus 3.

The housing 1 is provided with a water flowing chamber 11, and a first water inlet 12 and a first connection port 13 that communicate with the water flowing chamber 11.

The waterway adjusting member 2 rotatably fits in the water flowing chamber 11 and movably seals an opening of the water flowing chamber 11, two sides of a peripheral surface of an inner-side end thereof are respectively provided with a water flowing slot 21 and a second water inlet 22, and an outer-side end of the waterway adjusting member 2 is provided with a second connection port 23. As the waterway adjusting member 2 rotates, communication relationships of the first water inlet 12 with the water flowing slot 21 and the second water inlet 22 are changed, to achieve communication with the first connection port 13 via the water flowing slot 21 or with the second connection port 23 via the second water inlet 22.

The shower fixing apparatus 3 is mounted on an outer side of the housing 1, for example, another side opposite the first water inlet 12, and is configured to magnetically fix a handheld shower.

According to the above solution of this patent, the shower column in the bathroom can be functionally replaced, and the overhead shower and the handheld shower can both be mounted on the housing 1. Specifically, the overhead shower is connected to the first connection port 13 to achieve relative fixation with the housing and the water inlet function of the overhead shower; and the handheld shower is detachably mounted on the shower fixing apparatus 3 by magnetic means, making the operation convenient and quick, and connected to the second connection port 23 via a water pipe to achieve the water inlet function of the handheld shower. In addition, the waterway adjusting member 2 can not only supply water to the handheld shower but also provide the waterway switching function. By rotating the waterway adjusting member 2, the user can change the relative angle between the water flowing slot 21, the second water inlet 22, and the first water inlet 12, thus determining which waterway the first water inlet 12 communicates with, achieving the opening, closing, and switching functions of the waterway. This results in rich functions and simple operation; especially a corresponding waterway is opened for the handheld shower when the handheld shower is removed from the housing 1, making the operation handy and convenient, thus providing an excellent user experience.

The following shows specific implementations of this patent.

The water flowing chamber 11 is an inner chamber that is cylindrical or approximately cylindrical, the first water inlet 12 and the shower fixing apparatus 3 are respectively located on two sides of the water flowing chamber 11, and the first connection port 13 is located in the end face of the water flowing chamber 11.

Peripheral surfaces of outer ends of the first connection port 13 and the second connection port 23 are each provided with an external thread for quick connection to the overhead shower and a water pipe.

A peripheral surface of the waterway adjusting member 2 is provided with at least one mounting ring slot 24, a sealing ring 4 is disposed in the mounting ring slot 24, and the sealing ring 4 movably and sealingly fits between the peripheral surface of the waterway adjusting member 2 and an inner wall of the opening of the water flowing chamber 11.

A first sealing gasket 5 is embedded around the second water inlet 22, and the first sealing gasket 5 movably and sealingly fits with an inner wall of the water flowing chamber 11 as the waterway adjusting member 2 rotates, ensuring that when the first water inlet 12 is not aligned with the second water inlet 22, water does not enter the waterway adjusting member 2.

A peripheral surface of the outer-side end of the waterway adjusting member 2 is provided with a toggle 25, making it easier for the user to operate the waterway adjusting member 2.

The peripheral surface of the inner-side end of the waterway adjusting member 2 is provided with a movable slot 26, a limiting pin 6 is mounted in the housing 1, and the limiting pin 6 movably fits in the movable slot 26. The length of the movable slot 26 is designed to allow the waterway adjusting member 2 to move circumferentially while also restricting its rotation angle, preventing the waterway adjusting member 4 from loosening from the valve body 5.

A peripheral surface of the housing 1 is provided with a mounting slot 14, and the shower fixing apparatus 3 includes a fixed seat 31 fixed relatively in the mounting slot 14 and a magnet 32 embedded in the fixed seat 31. Thus, the handheld shower with metal or a magnet can be fixed by magnetic means, making it more convenient to take and place the shower.

Further, several fixed posts 15 are provided in the mounting slot 14, the fixed seat 31 is fixed to the fixed posts 15 by screws, and a protective cover 33 for covering the screws is mounted on a surface of the fixed seat 31 through snap connection, which can prevent the screws from rusting due to long-term water exposure. A limiting cover 34 is provided in the fixed seat 31 to relatively fix the magnet 32 in the mounting slot 14, preventing shaking.

The connection ball head 7 is mounted in the first water inlet 12, and the connection ball head 7 is connected to a water supply pipe on a wall surface, facilitating adjustment of the angle of the housing 1, that is, allowing for flexible adjustment of the angles of the overhead shower and the handheld shower (when fixed to the housing).

Further, this patent includes a limiting nut 8 threadedly connected to the housing 1, a limiting ring 9 disposed in the limiting nut 8 and configured to prevent the connection ball head 7 from loosening and shaking, and a second sealing gasket 10 disposed between the connection ball head 7 and the first water inlet 12.

The above embodiments and drawings do not limit the form and style of the product of this patent. Any suitable changes or modifications made by those skilled in the art should be considered within the scope of this patent.

The invention claimed is:

1. A waterway switching apparatus with a magnetic function, comprising:

a housing, a waterway adjusting member, and a shower fixing apparatus, wherein the housing is provided with a water flowing chamber, and a first water inlet and a first connection port that communicate with the water flowing chamber; the first connection port comprises an outer end having an external thread thereon for connecting to an overhead shower;

the waterway adjusting member comprises an inner-side end and an outer-side; a water flowing slot is provided on one side of the inner-side end, and a second water inlet is provided on the other side of the inner-side end, and a second connection port is provided on an outer-side end; the second connection port comprises an outer end having an external thread thereon for connecting to a handheld shower via a water pipe;

the waterway adjusting member rotatably fits in the water flowing chamber and movably seals a bottom opening of the water flowing chamber, and as the waterway adjusting member rotates, communication relationships of the first water inlet with the water flowing slot and the second water inlet are changed, to achieve communication with the first connection port via the water flowing slot or with the second connection port via the second water inlet;

the shower fixing apparatus, which is configured to magnetically fix the handheld shower, is mounted on a side of the housing;

the peripheral surface of the inner-side end of the waterway adjusting member is provided with a movable slot, a limiting pin is mounted in the housing, and the limiting pin movably fits in the movable slot;

a peripheral surface of the waterway adjusting member is provided with at least one mounting ring slot, a sealing ring is disposed in the mounting ring slot, and the sealing ring movably fits and forms a seal between the peripheral surface of the waterway adjusting member and an inner wall of the opening of the water flowing chamber;

a peripheral surface of the housing is provided with a mounting slot, and the shower fixing apparatus comprises a fixed seat fixed relatively in the mounting slot and a magnet embedded in the fixed seat;

several fixed posts are disposed in the mounting slot, the fixed seat is fixed to the fixed posts by screws, a protective cover for covering the screws is mounted on a surface of the fixed seat through snap connection, and a limiting cover is disposed in the fixed seat and configured to relatively fix the magnet in the mounting slot;

a connection ball head is mounted in the first water inlet, and the connection ball head is connected to a water supply pipe; and a limiting nut threadedly connected to the housing, a limiting ring disposed in the limiting nut and configured to prevent the connection ball head from loosening and shaking, and a second sealing gasket disposed between the connection ball head and the first water inlet.

2. The waterway switching apparatus with a magnetic function according to claim 1, wherein the peripheral surfaces of outer ends of the first connection port and the second connection port are each provided with an external thread.

3. The waterway switching apparatus with a magnetic function according to claim 1, wherein a first sealing gasket is embedded around the second water inlet, and the first sealing gasket movably fits and forms a seal with an inner wall of the water flowing chamber as the waterway adjusting member rotates.

4. The waterway switching apparatus with a magnetic function according to claim 1, wherein a peripheral surface of the outer-side end of the waterway adjusting member is provided with a toggle.

* * * * *